US008069978B2

(12) United States Patent
Haire et al.

(10) Patent No.: US 8,069,978 B2
(45) Date of Patent: Dec. 6, 2011

(54) COIN HOLDER WITH EDGE VIEW OPTICS

(75) Inventors: Robert A. Haire, Waterford, MI (US); Joseph Jarski, Riley Township, MI (US)

(73) Assignee: Muroc Masters Research and Development, LLC, Waterford, MI (US)

( * ) Notice: Subject to any disclaimer, the term of this patent is extended or adjusted under 35 U.S.C. 154(b) by 304 days.

(21) Appl. No.: 12/581,252

(22) Filed: Oct. 19, 2009

(65) Prior Publication Data

US 2011/0089052 A1 Apr. 21, 2011

(51) Int. Cl.
*B65D 85/58* (2006.01)

(52) U.S. Cl. ..... 206/0.8; 206/457

(58) Field of Classification Search ..... 206/0.8, 206/0.81, 0.82, 0.83, 0.84, 449, 454, 455, 206/457, 459.1
See application file for complete search history.

(56) References Cited

U.S. PATENT DOCUMENTS

| | | | | |
|---|---|---|---|---|
| 3,139,977 | A | 7/1964 | Burdick | |
| 3,429,425 | A | 2/1969 | Hebert | |
| 4,040,724 | A | 8/1977 | Klingler | |
| 4,399,910 | A * | 8/1983 | Gutentag | 206/0.82 |
| 4,805,680 | A | 2/1989 | Ueno | |
| 5,042,650 | A * | 8/1991 | Mayer et al. | 206/0.84 |
| 5,133,451 | A | 7/1992 | Boyd et al. | |
| 5,544,741 | A | 8/1996 | Fantone et al. | |
| 5,941,382 | A | 8/1999 | Fantone et al. | |
| 6,029,807 | A * | 2/2000 | Love | 206/0.82 |
| 6,604,626 | B1 | 8/2003 | Hanshaw | |
| 2006/0278539 | A1 | 12/2006 | Fager | |
| 2008/0230402 | A1 * | 9/2008 | Macor | 206/81 |
| 2009/0045077 | A1 | 2/2009 | Counts | |
| 2010/0039818 | A1 * | 2/2010 | Haddock | 362/253 |
| 2010/0258454 | A1 * | 10/2010 | Thomas | 206/83 |

FOREIGN PATENT DOCUMENTS

WO WO 02/24470 A1 3/2002

* cited by examiner

*Primary Examiner* — Jacob K Ackun
(74) *Attorney, Agent, or Firm* — Warn Partners, P.C.; Gregory L. Ozga

(57) ABSTRACT

A coin holder having edge view optics. The coin holder includes a coin having an obverse side, a reverse side and a coin edge having features on the coin edge. The features can include lettering, decorative patterns or other features of interest. An optical frame is configured to surround the coin edge and includes reflective surfaces that project an image of the coin edge to a viewing side of the optical frame, where the features of the coin edge can be viewed in a desired orientation.

16 Claims, 4 Drawing Sheets

COIN HOLDER WITH EDGE VIEW OPTICS

FIELD OF THE INVENTION

The present invention relates to a coin holder having edge view optics.

BACKGROUND OF THE INVENTION

In the coin collecting field there has been an increased demand for collectable coins that have a greater number of features and decorative patterns. Many of the newer collectible coins, as well as some older coins, have engraving or writing on the edge of the coin. Being able to view the features of the edge is problematic for numismatists because many seek to protect their precious and often times valuable coins by encasing them in containers, called slabs, which protect them from handling and the environment. The use of the containers also makes it difficult to view the quality of the edge of the coin to determine if there are dings, scratches or other sort of damages to the coin edge.

Most of the slabs used today do not provide a way of viewing the edge of the coin. Some attempts have been made to provide coin slabs that have viewing features that allow the edge of the coin to be viewed. One example is a coin slab that has a protruding coin holder surface that raises the coin off of the surface of the slab so that the edge can be viewed when the slab is turned on its side. This type of coin holder allows the viewer to see the side of the coin; however, the slab must be turned on its side or at an angle in order for the lettering on the edge of the coin to be viewed. Additionally this type of slab is not desirable because of difficulties in stacking the slabs for storage because of a raised surface on the slab itself. Another attempt provides a coin slab has been designed to include a magnification circle. The magnification circle encircles the edge of the coin and has a single reflective surface that projects a magnified, inverted image of the edge lettering of the coin. An inverted image of the edge of the coin can be viewed when a person is examining the face of the coin. This particular attempt projects an inverted image that is dark and distorted.

One other attempt of a coin slab design implements four tabs that hold the coin in place within the slab. Between the tabs is a gap that allows the edge of the coin to be viewed directly by holding the slab on an angle. This attempt does not use any projections or reflective surfaces but relies on allowing the edge to be viewed directly. However, the view of the edge is minimal due to the glare that often occurs from holding the slab at an angle. Thus there is a need to provide better quality edge viewing slab designs.

The field of coin collecting also requires a certain level of security in order to ensure a coin's authenticity. Once a coin has been graded or valued it generally receives a certificate of authenticity that specifies the grade value which all compute to the coins value. In order to maintain the integrity of the coin grading process, the coins are often sealed in slabs along with the certificate of grading. Counterfeit coin slab casings have been discovered. These casings include certificates that purport to have been from a reputable grading service, when they are in fact fake certificates and coins that do not contain the purported level of grading specified on the certificate. These fraudulent acts harm the reputation of the entire field since collectors cannot be certain they are getting what they think they are purchasing. Thus there is a need to improve the security features of the slabs themselves.

SUMMARY OF THE INVENTION

The present invention is directed to a coin holder having edge view optics. The coin holder includes a coin having an obverse side, a reverse side and a coin edge with features on the coin edge. The features can include lettering, decorative patterns or other features of interest. An optical frame is configured to surround the coin edge and includes a viewing side of the optical frame where the features of the coin edge can be viewed in a desired orientation. An inner side of the optical frame is located adjacent at least a portion of the coin edge and can include features such as a ledge for preventing the coin from sliding through the inner side of the optical frame. An angled outer side of the optical frame is located substantially opposite the inner side and includes a reflective surface capable of reflecting an inverted image of the features of the coin edge. The optical frame further includes an angled bottom side that is positioned opposite and aligned with the angled outer side and also includes a reflective surface. The reflective surface of the angled bottom side receives the inverted image reflected from the angled outer side and projects a double inverted image of the features through the viewing side such that the features are viewed in a desired orientation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
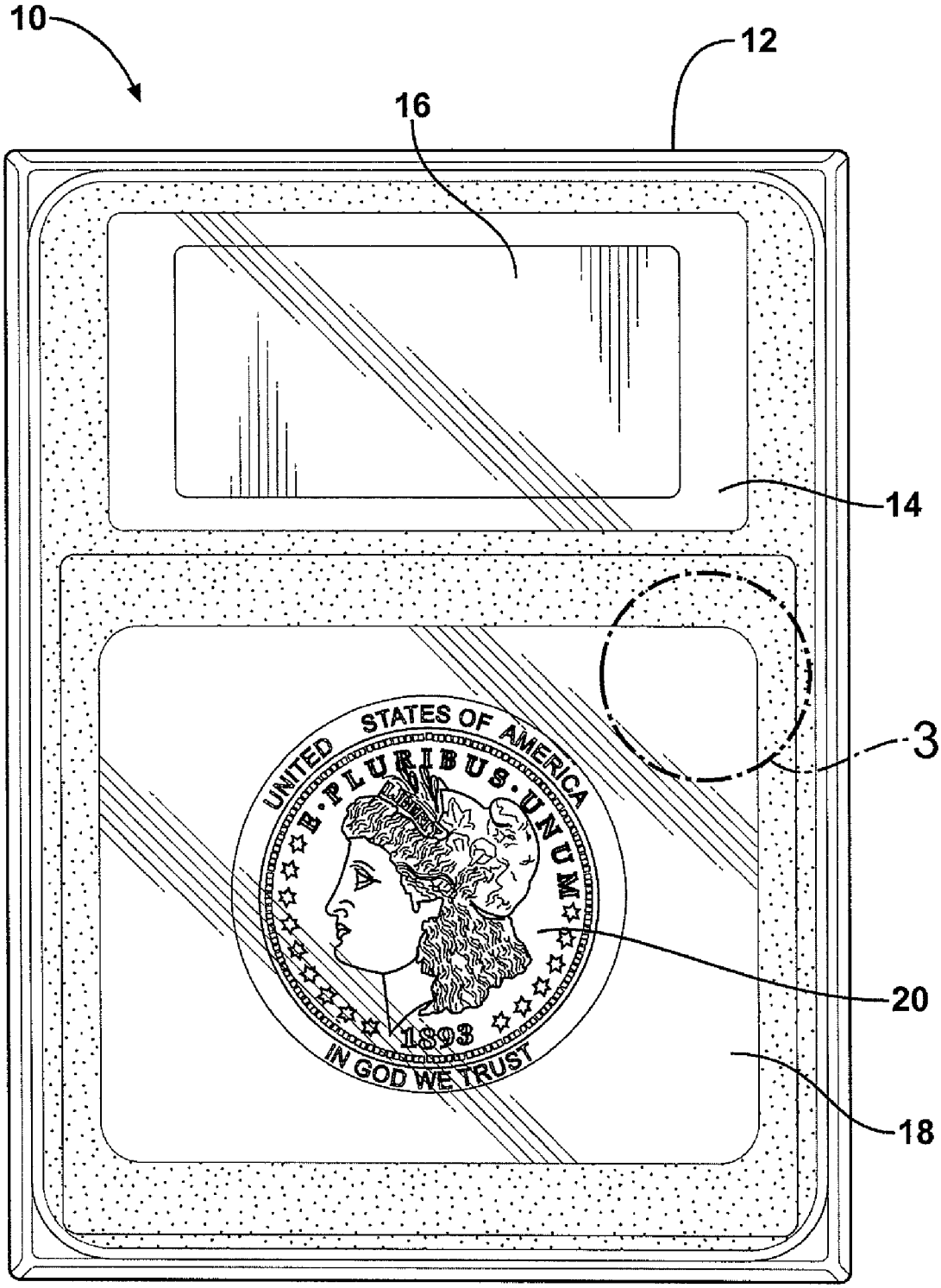
FIG. 1 is an obverse side plan view of a coin contained within the coin holder with edge view optics.

Referring now to all of the figures generally, and more specifically FIG. 1, a coin holder 10 is shown. The coin holder 10 as shown in FIG. 1 has a casing 12 having a security window 14 for viewing a security certificate 16 which can contain grading information about a coin 20 contained within the coin holder 10. The coin holder 10 also includes a coin window 18 where the coin 20 can be viewed.

Figure 2:
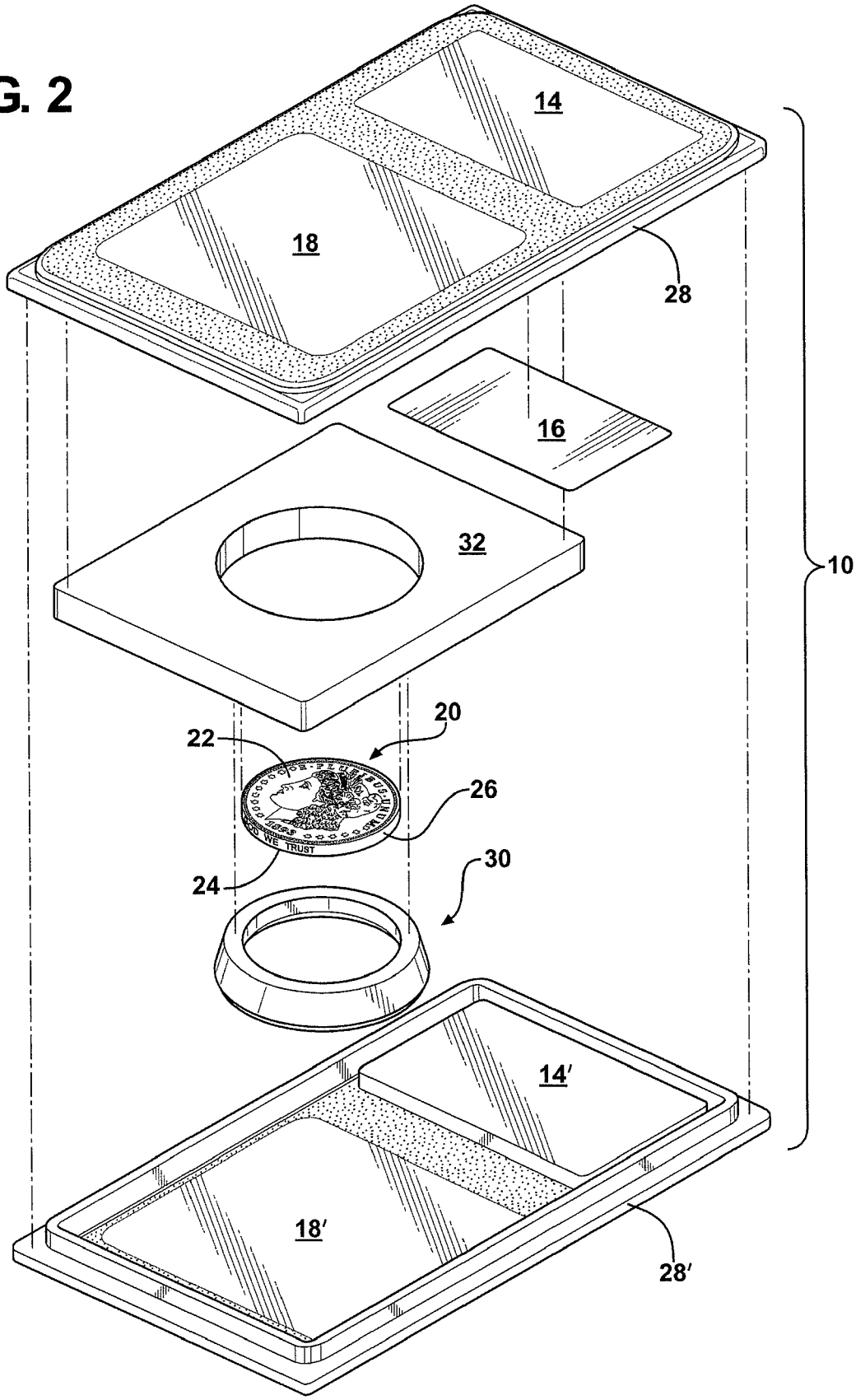
FIG. 2 is an exploded perspective view of the coin holder with edge view optics.
Figure 3:
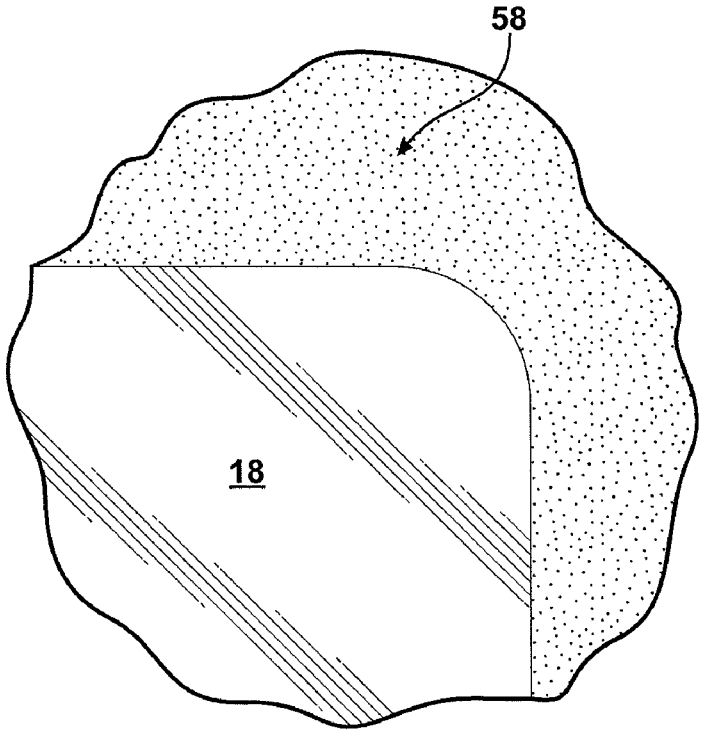
FIG. 3 is an enlarged plan view of the fingercasing of the coin holder.

Referring also to FIG. 2, the casing 10 is shown in an exploded view. The coin holder 10 is configured to hold the coin 20 which has an obverse side 22, reverse side 24 and edge 26. The term obverse as used herein can be interchanged with the words front or heads side of the coin and the term reverse can be interchanged with the words back or tails side of the coin. Written on the edge 26 of the coin 20 are features, which in the exemplary embodiment shown in FIG. 2 have the words "IN GOD WE TRUST" and "UNITED STATES OF AMERICA" engraved thereon. The casing 12 has two pieces 28, 28' forming an upper and lower, each having their own security window 14, 14' and coin window 18, 18' for viewing the obverse side and reverse side of the certificate 16 and coin 20. Surrounding the coin 20 is an optical frame 30 that is positioned adjacent to the coin 20. The optical frame 30 and coin 20 are further encircled by an insert 32 formed of rubber or other suitable material and having an aperture for receiving the optical frame 30 and coin 20. The insert 32 holds the optical frame 30 and coin 20 in place and is locked into place by the two pieces 28, 28' of the casing 12.

Figure 4A:
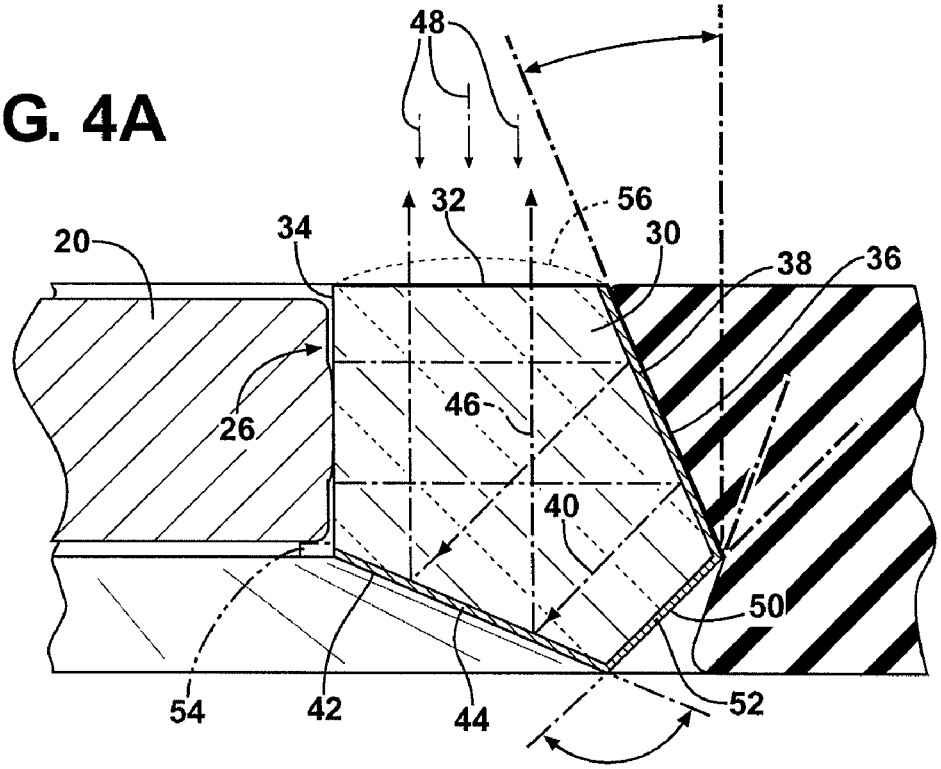
FIG. 4*a* is a partial cross sectional view of the coin holder and the optical frame.

Referring to FIGS. 1, 2 and 4*a*, the optical frame 30 provides edge view optics that allows a person looking at the obverse side 22 or reverse side 24 of the coin to also see the features engraved on the edge 26 of the coin 20 without having to turn the coin holder 10. The optical frame 30 provides the edge view optics by having a double reflective prismatic configuration that reflects the undistorted features of the edge 26 through a viewing side 32 of the optical frame. As shown in FIGS. 1, 2 and 4, the prismatic configuration of the optical frame 30 is a circular prism having a pentaprism cross-section; however, the present invention contemplates other cross-sectional shapes depending on the needs of a particular application.

The viewing side 32 of the optical frame is positioned either around the obverse side 22 or reverse side 24 of the coin and can be viewed through either coin window 18, 18' depending on what way the viewing side 32 faces within coin holder 10.

The optical frame 30 has an inner side 34 that is adjacent to and in contact with the edge 26 of the coin 20. The inner side 34 of the optical frame 30 is transparent and allows the features of the edge 26 to be projected to an angled outer side 36 of the optical frame 30 which is located substantially opposed to the inner side 34 of the optical frame 30. The angled outer edge 36 has a reflective surface layer 38, which receives a projected image of the edge 26 through the inner side 34. The reflective surface layer 38 then inverts and projects an inverted image 40 of the edge 26 to an angled bottom side 42 of the optical frame 30. The angled bottom side 42 has a reflective surface layer 44 that receives the inverted image 40. The reflective surface layer 44 then projects a double inverted image 46 to the viewing side 32 of the optical frame 30. When a person looking at the coin holder 10 looks at the viewing side 32 of the assembled coin holder 10, they can see both the obverse side 22 or reverse side 24 of the coin 20 and depending upon what side the viewing side 32 is positioned the features of the edge 26 are seen adjacent the obverse side 22 or reverse side 24.

The term double inverted image as used in the present invention means that the image is projected from the reflective surface of the angled bottom side 42 in a way that the features of the edge 26 are viewed in a desired orientation. For example, in the exemplary embodiment shown in FIGS. 1 and 2 the words "UNITED STATES OF AMERICA" and "IN GOD WE TRUST" are viewed in their correct orientation so that they can be read and are not inverted or distorted in any way.

The reflective surface 38 and the reflective surface 44 are created by applying a reflective layer of aluminum, silver or other suitable material. The reflective layer is applied by vapor deposition or other similar means. The reflective surface provides an additional advantage in that rays of light 48 passing through the viewing side 32 of the optical frame 30 are reflected off of the reflective surface 44 and reflective surface 38 toward the edge 26. This provides illumination within the optical frame 30 so that the double inverted image 46 is brighter and appears with greater clarity. This prevents the image viewed through the viewing side 32 from appearing dark and distorted.

In exemplary embodiment shown in FIG. 4*a*, the optical frame 30 has a pentaprism shape and includes a base side 50 that may also have a reflective surface 52 formed thereon that assists in reflecting rays of light 48 as well as projecting the double inverted image 46. The angled outer side 36, angled bottom side 42 and base side 50 all have various angles relative to the edge 26 of the coin 20 that control the double inverted image that controls the quality or shape of the double inverted image 46 projected through the viewing side 32 of the optical frame. The angled outer side 36 preferably has an angle between substantially 15 degrees to substantially 30 degrees. The angled bottom side 42 has an angle between substantially 15 degrees to substantially 30 degrees. If the base side 50 is implemented on the optical frame, the base side will have an angle substantially 40 degrees to substantially 50 degrees.

Figure 4B:
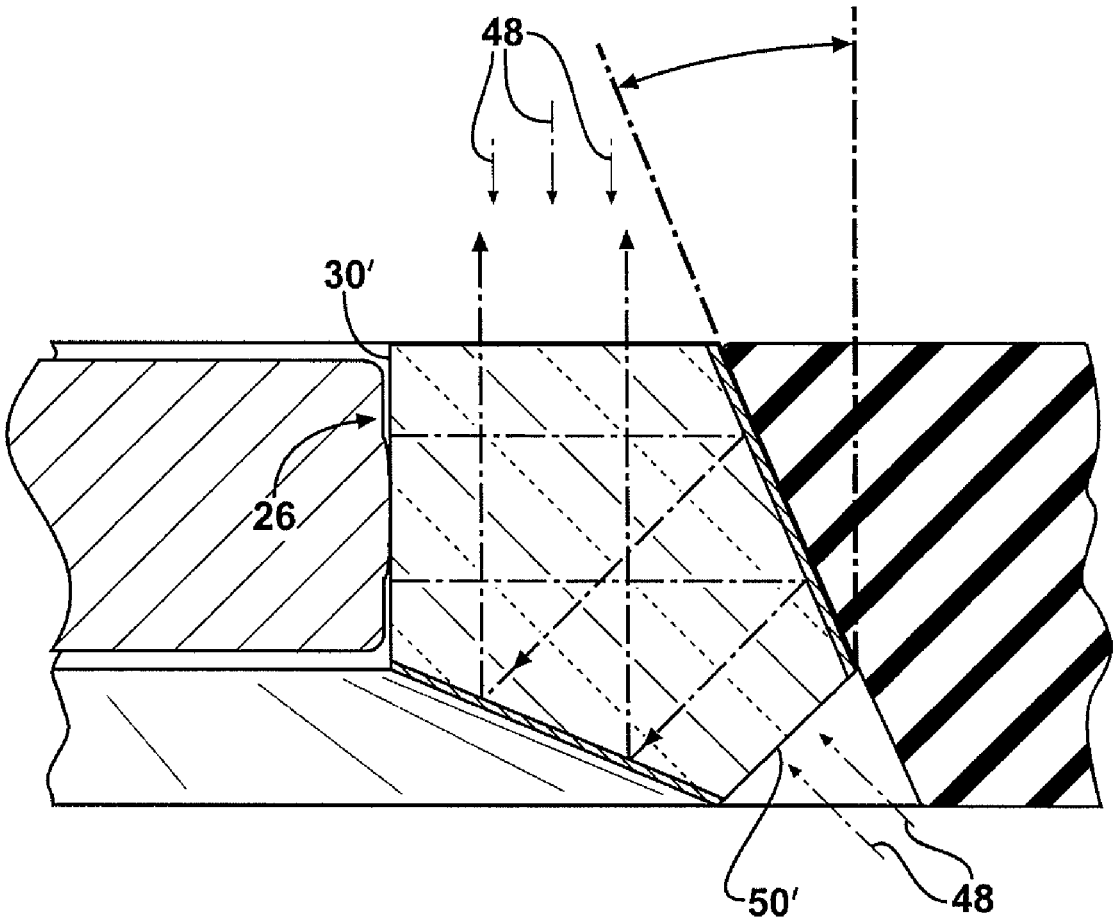
FIG. 4*b* is a partial cross sectional view of the coin holder and the optical frame.

In another variation of the invention shown in FIG. 4*b* a base side 50' of an optical frame 30' is left transparent. This allows for rays of light 48 to pass though the base side 50' in addition to rays of light 48 passing through the viewing side 32. This embodiment of the optical frame 30' provides greater illumination of the coin edge because more light can pass through the optical frame 30' and illuminate the coin edge. This particular embodiment is useful when the coin edge is made of a dark metallic material such as copper or dark gold.

In another aspect of the present invention the inner side 34 of the optical frame 30 optionally includes a ledge 54. The ledge 54 is configured to contact the obverse side 22 or reverse side 24 of the coin 20 in order to ensure proper alignment of the edge 26 with the inner side 34, upon insertion of the coin 20 into the optical frame 30. The use of the ledge 54 ensures proper alignment as well as decreases assembly time for the coin holder 10 so it is practical for use in commercial or high volume applications.

In yet another aspect of the present invention the viewing side 32 of the optical frame 30 can include an angled magnifying surface or convex surface 56 that magnifies the double inverted image 46 so that the features on the edge 26 of the coin are enlarged and viewed more easily.

In another embodiment of the present invention the casing 12 includes a textured fingerprint 58 which borders the security window 14 and coin window 18. The textured fingerprint 58 has a unique pattern that allows the manufacturer of the casing 12 of the coin holder 10 to be able to check the authenticity of the casing in order to detect fake or counterfeit casings. The textured fingerprint 58 is unique to the specific mold that created the two pieces 28 of the casing 12. Upon examination of a particular casing 12 it can be determined whether or not the casing came from the purported grading service or casing manufacturer.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A coin holder with edge view optics comprising:

a coin having an obverse side, a reverse side and a coin edge having features on said coin edge;

an optical frame configured to surround said coin edge;

a viewing side of said optical frame wherein said features of said coin edge can be viewed in a desired orientation;

an inner side of said optical frame located adjacent at least a portion of said coin edge;

an angled outer side of said optical frame located substantially opposite said inner side, said angled outer side having a reflective surface capable of reflecting an inverted image of said features; and an angled bottom side of said optical frame positioned opposite said angled outer side, wherein said angled bottom side has a reflective surface for receiving said inverted image reflected from said angled outer side and projecting a double inverted image of said features through said viewing side.

2. The coin holder of claim 1 further comprising a ledge formed on said inner side of said optical frame for contacting one of said obverse side and said reverse side of said coin, wherein said ledge insures proper alignment of said features with said angled outer surface when said coin is surrounded by said optical frame.

3. The coin holder of claim 1 further comprising an angled magnifying surface on said viewing side of said optical frame such that said projected double inverted image is enlarged.

4. The coin holder of claim 1 further comprising a convex magnifying surface on said viewing side of said optical frame.

5. The coin holder of claim 1 wherein said angled outer side and said angled bottom side of said optical frame includes a mirror layer.

6. The coin holder of claim 1 further comprising an insert surrounding and supporting said optical frame;

a casing having at least two pieces connectable together such that said insert, said optical frame and said coin are encased by said casing when assembled.

7. The coin holder of claim 6 wherein said casing has a textured portion having a fingerprint pattern.

8. A coin holder with edge view optics comprising:

a coin having an obverse side, a reverse side and a coin edge having features on said coin edge;

an optical frame having a pentaprism cross section;

a viewing side of said pentaprism cross section wherein said features of said coin edge can be viewed in a desired rotation;

an inner side of said pentaprism cross section, located adjacent said coin edge and forming one vertex of said pentaprism by connecting to said viewing side of said pentaprism;

an angled outer side of said pentaprism cross section located substantially opposite said inner side and having a vertex connected to said viewing side, said angled outer side having a reflective surface capable of reflecting an inverted image of said features;

an angled bottom side of said pentaprism cross section positioned opposite said angled outer side and having a vertex at a connection between said angled bottom side and said inner side of said pentaprism, wherein said angled bottom side has a reflective surface for receiving said inverted image reflected from said angled outer side and projecting a double inverted image of said features through said viewing side; and a base side of said pentaprism cross section having a vertex connection with said angled bottom side at one end of said base side and a second vertex connection to said angled outer side.

9. The coin holder of claim 1 further comprising a reflective surface receives said inverted image from said angled outer side and projects a double inverted image of said features through said viewing side.

10. The coin holder of claim 8 wherein said base side is transparent and allows rays of light to pass through said base side, wherein said rays of light pass through said base side and illuminate said edge of said coin.

11. The coin holder of claim 8 further comprising a ledge formed on said inner side of said optical frame for contacting one of said obverse side and said reverse side of said coin, wherein said ledge insures proper alignment of said features with said angled outer surface when said coin is surrounded by said optical frame.

12. The coin holder of claim 8 further comprising an angled magnifying surface on said viewing side of said optical frame such that said projected double inverted image is enlarged.

13. The coin holder of claim 8 further comprising a convex magnifying surface on said viewing side of said optical frame.

14. The coin holder of claim 8 wherein said angled outer side and said angled bottom side of said optical frame includes a mirror layer.

15. The coin holder of claim 8 further comprising an insert surrounding and supporting said optical frame;

a casing having at least two pieces connectable together such that said insert, said optical frame and said coin are encased by said casing when assembled.

16. The coin holder of claim 8 wherein said casing has a textured portion having a fingerprint pattern.

* * * * *